US006005453A

United States Patent [19]

Särkkä et al.

[11] Patent Number: 6,005,453

[45] Date of Patent: Dec. 21, 1999

[54] METHOD OF TUNING SUMMING NETWORK OF BASE STATION FILTERS VIA CONNECTOR WITH MOVEABLE PART

[75] Inventors: Veli-Matti Särkkä, Oulunsalo; Timo Ahonpää, Oulu, both of Finland

[73] Assignee: Nokia Telecommunications Oy, Espoo, Finland

[21] Appl. No.: 09/066,352

[22] PCT Filed: Aug. 27, 1997

[86] PCT No.: PCT/FI97/00495

§ 371 Date: Apr. 28, 1998

§ 102(e) Date: Apr. 28, 1998

[87] PCT Pub. No.: WO98/09349

PCT Pub. Date: Mar. 5, 1998

[30] Foreign Application Priority Data

Aug. 29, 1996 [FI] Finland ..... 963378

[51] Int. Cl.[6] ..... H01P 5/04; H01P 1/213

[52] U.S. Cl. ..... 333/126; 333/134; 333/202; 333/230; 333/235; 333/254; 333/256; 439/578

[58] Field of Search ..... 333/100, 123, 333/126, 127, 134, 219.1, 230, 254, 256, 260, 33, 235; 439/578

[56] References Cited

U.S. PATENT DOCUMENTS

| | | | |
|---|---|---|---|
| 3,150,247 | 9/1964 | White | 333/260 X |
| 4,497,030 | 1/1985 | Bowling et al. | 364/481 |
| 4,667,172 | 5/1987 | Longshore et al. | 333/134 |
| 4,763,090 | 8/1988 | Pitschi | 333/260 |
| 4,902,991 | 2/1990 | Ishikawa et al. | 333/126 |
| 5,167,510 | 12/1992 | Plummer | 439/52 |
| 5,315,274 | 5/1994 | Sarkka | 333/219.1 |
| 5,545,949 | 8/1996 | Bacher | 333/230 X |
| 5,831,490 | 11/1998 | Särkkä et al. | 333/134 X |

FOREIGN PATENT DOCUMENTS

| | | |
|---|---|---|
| 1413021 | 11/1975 | United Kingdom . |
| 92/20116 | 11/1992 | WIPO . |
| 96/00989 | 1/1996 | WIPO . |
| 96/08848 | 3/1996 | WIPO . |

*Primary Examiner*—Robert Pascal
*Assistant Examiner*—Barbara Summons
*Attorney, Agent, or Firm*—Pillsbury Madison & Sutro

[57] ABSTRACT

A method of tuning a summing network of a base station and a band-pass filter provided in such base station. Tuning is performed by arranging a moveable part made of a low-loss dielectric material or ferrimagnetic material in a space between an inner conductor and a tubular conductor in a coaxial cable, the width of the cross-section of the moveable part being different from its length, and tuning the summing network by adjusting the phase angle reflecting from the connector by turning the moveable part about an axle which intersects the cross-section substantially perpendicularly, whereby the distance between the moveable part and the inner conductor and/or between the moveable part and the outer conductor changes.

10 Claims, 2 Drawing Sheets

METHOD OF TUNING SUMMING NETWORK OF BASE STATION FILTERS VIA CONNECTOR WITH MOVEABLE PART

This application is the national phase of international application PCT/F197/00495, filed Aug. 27, 1997 which designated the U.S.

BACKGROUND OF THE INVENTION

The invention relates to a method of tuning a summing network of a base station, the summing network comprising: transmitters, filter means with in-connectors for receiving signals supplied by the transmitters and out-connectors for forwarding filtered signals, and combiner means with in-connectors for receiving and combining the signals obtained from the out-connectors of the filter means and an out-connector for supplying the combined signals to antenna means of the base station, at least one of said connectors being a coaxial connector and comprising an elongated inner conductor and a substantially tubular conductor that surrounds the inner conductor and is arranged coaxially with the inner conductor. The invention also relates to a coaxial connector comprising an elongated inner conductor and a substantially tubular conductor that surrounds the inner conductor and is arranged coaxially with the inner conductor. The invention further relates to a band-pass filter comprising a resonator means, an in-connector for receiving signals to be filtered and for supplying them to an electromagnetic field of the resonator, and an out-connector for receiving filtered signals from the electromagnetic field of the resonator means and for supplying them further, at least one of the connectors being a coaxial connector and comprising an elongated inner conductor and a substantially tubular conductor that surrounds the inner conductor and is arranged coaxially with the inner conductor.

The invention particularly relates to a summing network of combiner filters of a base station in a cellular radio system. A combiner filter is a narrowband band-pass filter in resonance with (tuned to) the carrier frequency of a transmitter connected to it. The adjustment range of the filters is usually 2–10% of the medium frequency. The signals obtained from the outputs of the combiner filters are summed by the summing network of the base station and supplied to the antenna of the base station. The summing network usually comprises a coaxial cable which leads to the antenna of the base station and to which the combiner filters are connected. In order that a maximum amount of the transmission power of the transmitters could transfer to the antenna, the summing network must be tuned to the frequency channels used by the transmitters of the base station. To be exact, the summing network is tuned at only one frequency, but with movement away from the optimum frequency, the mismatch will not rise strikingly at first. In the base stations of cellular radio systems, the summing network can thus usually be used at a frequency band with a width of about 1 to 3% of the medium frequency of the frequency band.

Tuning of previously known summing networks is based on the use of transmission lines of a precise defined length, proportional to the wavelength. This sets high requirements to the cabling of a summing network, since the transmission lines must be of exactly the correct length so as to optimize the summing network to the correct frequency. Because of the tolerance requirements for the length of the cables required by the branches of the summing network, summing networks are quite expensive. As the operating frequency grows, the wavelength is reduced, and, on the other hand, as the physical size of the equipment sets certain requirements to the mechanical length of the summing network, the electric length of the summing network easily grows too long and the operating band of the combiner will narrow. The operating frequency band of the transmission combiner is thus in practice determined by the summing network, i.e. if the operating band is to be changed, the summing network or part of the network must be changed.

As automatically (remote control) adjustable combiner filters have become more common, a need has arisen for changing the tuning of the summing network in a simple and quick manner. The useful frequency band of the summing network is in practice so narrow that the frequency channels of the transmitters of the base station can hardly be changed at all if the tuning of the summing network is not adjusted as well. The previously known solution in which an installer goes to a base station site to replace the cabling of the summing network with cabling designed for a new frequency band is naturally too expensive and takes time.

BRIEF SUMMARY OF THE INVENTION

The object of the invention is to provide a solution to the above problem and to provide a method by which the summing network can be tuned more quickly, easily and accurately. The object will be achieved by the method of the invention, which is characterized by arranging a moveable part made of low-loss dielectric material or ferrimagnetic material in a space between the inner conductor and the tubular conductor in the coaxial connector, the width of a cross-section of the moveable part being different from the length, and tuning the summing network by adjusting the phase angle of a wave reflecting from said connector by turning the moveable part about an axle intersecting said cross-section substantially perpendicularly so that the distance between the moveable part and the inner conductor, and/or between the moveable part and the outer conductor, changes.

The invention is based on the idea that in base stations with a fixed summing network, the operating band of the summing network can be widened considerably by replacing the fixed in- and/or out-connectors used in the summing network with connectors according to the invention, in which the phase angle of a wave reflecting from the connector can be adjusted by turning the dielectric or ferrimagnetic part therein to a suitable position. Since there is an electric field between the inner conductor and outer conductor of the coaxial structure, the field at the moveable part can be affected by turning the moveable part, whereby the phase angle of the reflection coefficient of the connector also changes. In the invention, the adjustable structure of the connector in a fixed summing network compensates for the wavelength error (=phase angle error of reflection coefficient S11) generated at medium frequencies. Because of the adjustable connector arranged in a filter or e.g. a summing point (star point) of the summing network, the combined electric length of the filter and the summing cable connected to the summing point of the summing network is always correct ($n*\lambda/4$), i.e. the S11 phase angle as seen from the summing point is 0° (360°). The primary advantages of the method of the invention are, therefore, that the tuning of the summing network can be modified simply and quickly without needing to modify the cabling of the summing network.

The invention also relates to a coaxial connector that can be used in applying the method of the invention. The connector of the invention is characterized in that the connector comprises a moveable part of low-loss dielectric material or ferrimagnetic material, the width of a cross-section of the moveable part being different from the length, and to adjust the phase angle of a wave reflecting from the connector, said moveable part is arranged in a space between the inner conductor and the outer conductor, where it can be turned about an axle intersecting said cross-section substantially perpendicularly so that the distance between the moveable part and the inner conductor, and/or between the moveable part and the outer conductor, changes.

The invention further relates to a band-pass filter by which the method of the invention can be applied and in which the connector according to the invention can be used. The band-pass filter of the invention is characterized in that said coaxial connector comprises a moveable part of low-loss dielectric material or ferrimagnetic material, the width of a cross-section of the moveable part being different from the length, and that to adjust the phase angle of a wave reflecting from the connector, said moveable part is arranged in a space between the inner conductor and the outer conductor, where it can be turned about an axle intersecting said cross-section substantially perpendicularly so that the distance between the moveable part and the inner conductor, and/or between the moveable part and the outer conductor, changes.

The preferred embodiments of the method, connector and bandpass filter according to the invention appear from the attached dependent claims 2 to 4, 6 to 8, and 10.

BRIEF DESCRIPTION OF THE SEVERAL VIEWS OF THE DRAWING

In the following the invention will be described in greater detail by way of an example, with reference to the attached drawings, in which.

DETAILED DESCRIPTION OF THE INVENTION

Figure 1:
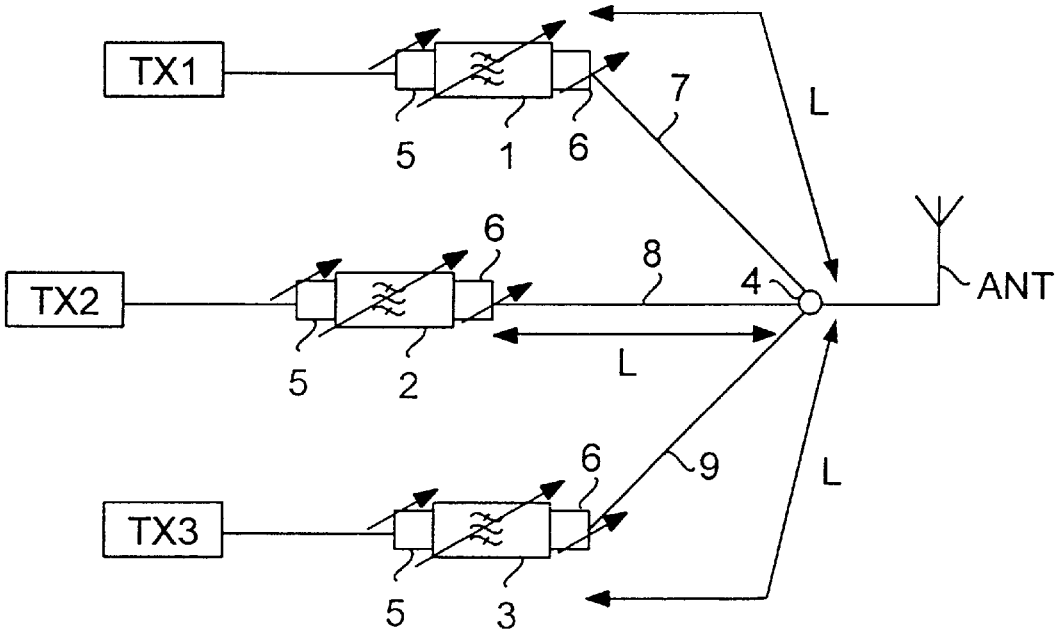
FIG. 1 is a block diagram illustrating a summing network of a base station in which the method of the invention can be used.

FIG. 1 is a block diagram illustrating a summing network of a base station in which the method of the invention can be applied. The summing network shown in FIG. 1 can be, for example, a summing network of a base station of the GSM mobile system, three transmission units TX1–TX3 being connected via the network to a common transmitting antenna ANT. Band-pass filters 1–3 shown in FIG. 1 are filters known per se, and their pass band can be adjusted, preferably by remote control, from the network management centre. The structure and operation of adjustable dielectric resonators are described, for example, in Finnish Patent 88,227, 'Dielectric resonator.'

Each transmission unit TX1–TX3 is connected in FIG. 1 to an in-connector 5 of the corresponding adjustable band-pass filter 1–3. Correspondingly, out-connectors 6 of the band-pass filters 1–3 are connected to a summing element 4 (star point) by means of transmission cables 7–9 of equal length L, and in the summing element, signals from different transmitters are summed before they are supplied to the antenna ANT. The out-connector 6 of each filter 1–3 adjusting to the medium frequency always maintains correct ($n^*\lambda/4$) the combined electric length of the filter 1–3 and the summing cable 7–9 connected to the summing element 4, i.e. the reflecting wave and the propagating wave as seen from the summing element 4 are cophasal. The out-connectors 6 preferably adjust automatically to a new optimum value as the pass band of the band-pass filters 1–3 is adjusted by remote control.

In FIG. 1, the in-connectors 5 of the filters 1–3 are also adjustable. This, however, is not as necessary for the summing operation as the adjustability of the out-connectors.

In the invention, the in-connectors of the summing element can also be made adjustable, which is different from what is shown in FIG. 1. Consequently, common non-adjustable out-connectors can be used in the filters, since the summing network can then be tuned by adjusting the phase angle of the wave reflecting from the in-connectors of the summing element. Also the out-connector of the summing element can be made adjustable.

Figure 2:
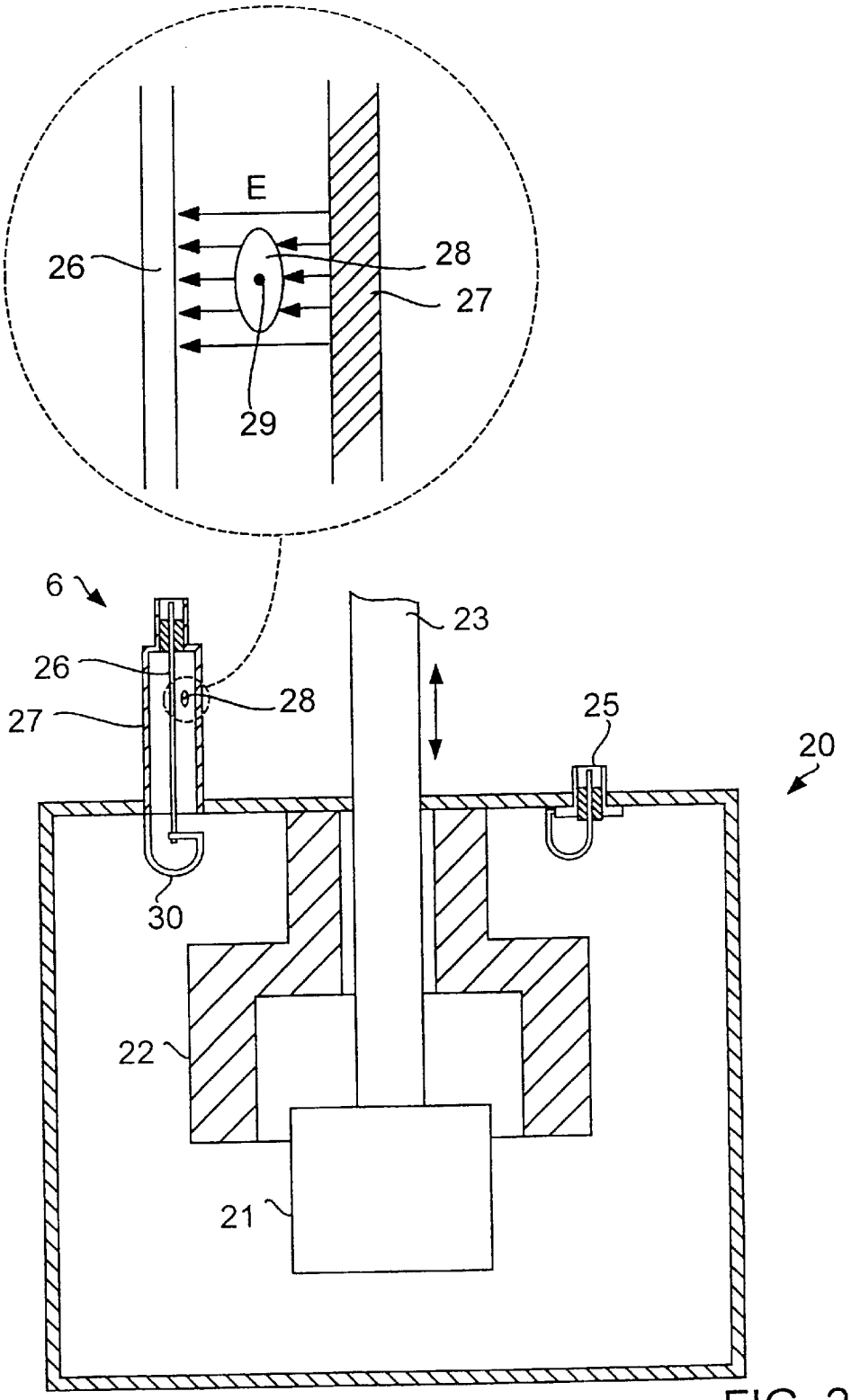
FIG. 2 illustrates a first preferred embodiment of a band-pass filter according to the invention.

FIG. 2 illustrates a first preferred embodiment of a band-pass filter 20 according to the invention. The band-pass filter of FIG. 2, which is known per se, is useful e.g. in a base station of a cellular radio system, and comprises a resonator that consists of two elements 21 and 22 made of dielectric material (e.g. ceramic).

The band-pass filter 20 is adjustable, whereby the operator can adjust the resonance frequency of the resonator by remote control so that the frequency corresponds to the medium frequency of the frequency band of the transmission unit connected to it. For this, the filter 20 comprises an actuator (not shown in FIG. 2) that can move, by means of an arm 23, the moveable dielectric element 21 in relation to the dielectric element 22 fixed to the casing of the filter 20. The mutual position of the dielectric elements 21 and 22, in turn, defines the resonance frequency of the resonator, the frequency in FIG. 2 varying e.g. within the range of 1805 to 1880 MHz.

In FIG. 2, the out-connector 6 of the band-pass filter 20, by which the filter 20 is connected to the summing element of the summing network of the base station and further to the antenna, is adjustable. The in-connector 25 of the band-pass filter, in turn, by which the band-pass filter 20 is connected to the transmission unit, is a common non-adjustable connector 25.

The coaxial adjustable out-connector 6 of the band-pass filter 20 comprises an elongated inner conductor 26, and a substantially tubular outer conductor 27 arranged coaxially with the inner conductor. In FIG. 2, the inner conductor 26 is connected to the outer conductor 27 by an inductive loop 30, through which a coaxial cable to be connected to connector 6 can be connected to the electromagnetic field of the resonator 21–22.

As seen particularly from the enlarged view in FIG. 2, a moveable element 28 with a high dielectric coefficient and with a cross-section whose width is different from the length is arranged between the inner conductor 26 and outer conductor 27. Movable element 28 can be made of ceramic or polytetrafluoroethylene, sold under trademark TEFLON®. In FIG. 2, the moveable element 28 has an elliptic cross-section. The elliptic element 28 can be turned via an axle 29 (shows as a point in FIG. 2) protruding substantially perpendicularly to the elliptic cross-section from the midpoint of the element, whereby the distance between element 28 and the inner conductor 26 and, correspondingly, the distance between element 28 and the outer conductor 27, changes.

Since there is an electric field E between the inner conductor 26 and the outer conductor, the electric field prevailing at the elliptic element 28 and thereby the phase angle of the reflection coefficient can be affected by turning the element. Any change in the field depends on the choice of material, the size of the element 28, and the position of the element 28 in the connector 6.

In connection with the band-pass filter 20 is preferably arranged an actuator (e.g. electric motor) which turns the elliptic element 28 via the axle 29 protruding from an aperture (not shown in the figure) in the tubular conductor 27. The actuator is preferably controlled by the same adjustment unit/control signal that the resonance frequency of the resonator is modified with, which enables a change in the phase angle of the wave reflecting from the connector 6 as the band-pass frequency of the band-pass filter is changed, such that the summing network remains tuned.

The above description and the accompanying drawings are to be understood only as illustrating the present invention. It will be obvious to a person skilled in the art that the invention can be varied and modified in many ways without deviating from the scope and spirit of the invention as disclosed in the attached claims.

We claim:

1. A method of tuning a summing network of a base station, the summing network comprising:

transmitters, filter means with in-connectors for receiving signals supplied by the transmitters and out-connectors for forwarding filtered signals, and combiner means with in-connectors for receiving and combining the signals obtained from the out-connectors of the filter means and an out-connector for supplying the combined signals to antenna means of the base station, at least one of said connectors being a coaxial connector and comprising an elongated inner conductor and a substantially tubular conductor that surrounds the inner conductor and is arranged coaxially with the inner conductor, said method comprising:

arranging a moveable part made of low-loss dielectric material or ferrimagnetic material in a space between the inner conductor and the tubular conductor in the coaxial connector, the width of a cross-section of the moveable part being different from the length, and tuning the summing network by adjusting a phase angle of a wave reflecting from said connector by turning the moveable part about an axle intersecting said cross-section substantially perpendicularly, whereby the distance between the moveable part and the inner conductor, and/or between the moveable part and the outer conductor, changes.

2. A method according to claim 1, wherein the cross-section of the moveable part is substantially elliptic, and that the moveable part is turned about an axle perpendicularly intersecting the midpoint of the substantially elliptic cross-section.

3. A method according to claim 1, wherein said at least one connector is an in- or out-connector of a filter means of the summing network.

4. A method according to claim 1, wherein said at least one connector is an in- or out-connector of the combiner means of the summing network of a base station.

5. A coaxial connector comprising an elongated inner conductor, a substantially tubular conductor that surrounds the inner conductor and is arranged coaxially with the inner conductor, a moveable part of low-loss dielectric material or ferrimagnetic material, the width of a cross-section of the moveable part being different from the length, and to adjust a phase angle of a wave reflecting from the connector, said moveable part is arranged in a space between the inner conductor and the outer conductor, where it can be turned about an axle intersecting said cross-section substantially perpendicularly so that the distance between the moveable part and the inner conductor, and/or between the moveable part and the outer conductor, changes.

6. A connector according to claim 5, wherein said moveable part is substantially elliptic in cross-section, and that the moveable part can be turned about said axle perpendicularly intersecting the midpoint of said substantially elliptic cross-section so as to adjust the phase angle of a wave reflecting from the connector.

7. A connector according to claim 5, said connector is a coaxial connector for connecting a coaxial cable to an electromagnetic field of a resonator.

8. A connector according to claim 5, wherein said moveable part is made of ceramic or polytetrafluoroethylene.

9. A band-pass filter comprising:

a resonator means, an in-connector for receiving signals to be filtered and for supplying them to an electromagnetic field of the resonator means, and an out-connector for receiving filtered signals from the electromagnetic field of the resonator means and for supplying them further, at least one of the connectors being a coaxial connector and comprising an elongated inner conductor and a substantially tubular conductor that surrounds the inner conductor and is arranged coaxially with the inner conductor, wherein said coaxial connector comprises a moveable part of low-loss dielectric material or ferrimagnetic material, the width of a cross-section of the moveable part being different from the length, and to adjust a phase angle of a wave reflecting from the connector, said moveable part is arranged in a space between the inner conductor and the outer conductor, where it can be turned about an axle intersecting said cross-section substantially perpendicularly so that the distance between the moveable part and the inner conductor, and/or between the moveable part and the outer conductor, changes.

10. A filter according to claim 9, wherein said moveable part is substantially elliptic in cross-section, that the filter further comprises adjustment means for adjusting a resonance frequency of the resonator, and that the frequency adjustment means are operationally connected to the moveable part to turn the part so as to adjust the phase angle of a wave reflecting from the connector when the resonance frequency of the resonator is adjusted.

* * * * *